US009501081B2

(12) United States Patent
Pigott

(10) Patent No.: US 9,501,081 B2
(45) Date of Patent: Nov. 22, 2016

(54) METHOD AND CIRCUIT FOR GENERATING A PROPORTIONAL-TO-ABSOLUTE-TEMPERATURE CURRENT SOURCE

(71) Applicant: John M. Pigott, Phoenix, AZ (US)

(72) Inventor: John M. Pigott, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 72 days.

(21) Appl. No.: 14/572,767

(22) Filed: Dec. 16, 2014

(65) Prior Publication Data

US 2016/0170433 A1 Jun. 16, 2016

(51) Int. Cl.

| | |
|---|---|
| ***H01L 35/00*** | (2006.01) |
| ***H01L 37/00*** | (2006.01) |
| ***H03K 3/42*** | (2006.01) |
| ***H03K 17/78*** | (2006.01) |
| ***G05F 3/26*** | (2006.01) |

(52) U.S. Cl.
CPC ..... *G05F 3/267* (2013.01)

(58) Field of Classification Search
CPC .... H03K 17/14; H03K 17/145; H03K 17/16; H03K 19/00369; G05F 3/30; G05F 3/02
USPC ..... 327/512, 513, 538–543
See application file for complete search history.

(56) References Cited

U.S. PATENT DOCUMENTS

| | | | | |
|---|---|---|---|---|
| 4,157,493 | A | 6/1979 | Monticelli | |
| 4,450,367 | A | 5/1984 | Whatley | |
| 5,982,201 | A | 11/1999 | Brokaw et al. | |
| 7,952,421 | B2 | 5/2011 | Tripodi et al. | |
| 8,680,840 | B2 * | 3/2014 | Iacob | G05F 3/242 323/311 |

* cited by examiner

*Primary Examiner* — Lincoln Donovan
*Assistant Examiner* — Diana J Cheng

(57) ABSTRACT

A proportional-to-absolute-temperature ("PTAT") circuit includes a bias component; first, second, third, and fourth transistors; an output transistor; and a first resistive component. A first terminal of the bias component is coupled to a voltage supply node. The first and second transistors are connected to a second terminal of the bias component. The third and fourth transistors have different current densities. The first transistor is coupled to the third transistor. The second transistor is coupled to the fourth transistor. The fourth transistor and the first resistive component are coupled to a voltage common node. The output transistor has a control terminal coupled to the second and fourth transistors, a first current terminal connected to an output node, and a second current terminal coupled to the third transistor and the first resistive component. The PTAT circuit is configured to generate at least a portion of a PTAT current at the output node.

20 Claims, 7 Drawing Sheets

METHOD AND CIRCUIT FOR GENERATING A PROPORTIONAL-TO-ABSOLUTE-TEMPERATURE CURRENT SOURCE

FIELD

The present disclosure relates generally to regulated current sources and more particularly to a method and circuitry for a proportional-to-absolute-temperature current source.

BACKGROUND

Many integrated circuits ("ICs") need circuitry, such as an initial controlled current source for biasing or use as a reference, which starts up before the rest of the IC. This "start-up" circuitry controls and facilitates the start up of other portions of the IC.

It is easier to facilitate the biasing of the IC if there is some amount of control over the accuracy and the performance of the start-up circuit. It is also advantageous to have a current source that starts when the supply voltage is as low as possible and does not fail when the supply voltage "spikes" to a high level. For example, in the automotive industry, although a car has a 12 volt battery, the voltage can go as high as 40 volts to as low as 3 volts during some transient conditions.

Some current start-up circuitry does not operate at a wide enough supply voltage range to meet the needs of some applications, such as the above automotive example. Other start-up circuitry is complex due to the numerous components contained in the circuitry. This complex start-up circuitry can occupy too much area on the IC and consume more current than desired.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

Figure 1:
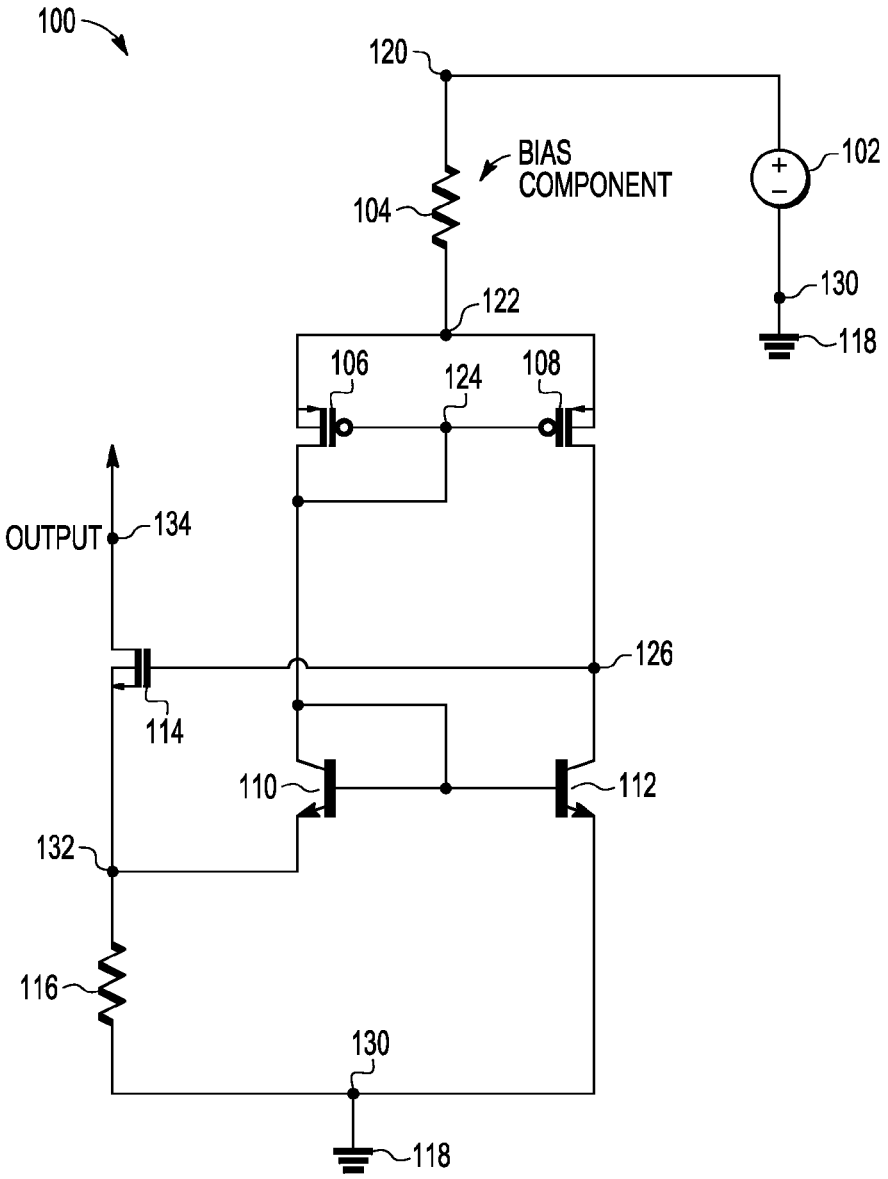
FIG. 1 is a circuit diagram illustrating a proportional-to-absolute-temperature ("PTAT") circuit, in accordance with an embodiment.

Embodiments presented herein are illustrated by way of example, and are not limited by the accompanying figures, in which like references indicate similar elements. Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The methods and circuitry components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

In accordance with an embodiment is a PTAT current source circuit architecture, also referred to herein as a PTAT circuit or PTAT circuitry, which can provide a regulated current source that can be used, for instance, as start-up circuitry on an IC. A PTAT circuit provides a PTAT current, which is a current that is substantially proportional to absolute temperature. Disclosed embodiments describe PTAT circuits that generate a PTAT current that can be provided to another circuit, for instance a circuit included on a same IC as the PTAT circuit. Embodiments of the PTAT circuit include a bias component coupled at a first terminal to a voltage source and directly connected at a second terminal to a current splitter having first and second transistors. The current splitter provides a first portion of a bias current from the bias component through the first transistor to a third transistor and provides a second portion of the bias current through the second transistor to a fourth transistor. The third and fourth transistors have a known difference in current densities. The first, second, third, and fourth transistors operate as an operational amplifier to enable the PTAT circuit to provide a regulated PTAT current that is based on the difference in current densities between the third and fourth transistors.

In a particular implementation, the generated PTAT current is proportional to $V_T \ln(N)$, where N is the ratio of current densities, e.g., based on size and current ratios, of the third and fourth transistors, and $V_T$ is the thermal voltage, which is described in detail later. Some embodiments provide this regulated PTAT current over a range of supply voltage values of less than 2 volts to over 40 volts, irrespective of the current through the bias component and also while using low-voltage space saving transistors in the current splitter.

FIG. 1 is a circuit diagram illustrating a PTAT circuit 100, in accordance with an embodiment. The PTAT circuit 100 includes: a voltage supply 102, also referred to herein as a voltage source and a supply voltage; a bias component 104; transistors 106, 108, 110, 112, and 114; and a first resistive component 116.

Illustratively, the bias component 104 is depicted as a resistor. However, the bias component 104 can be any component that allows current to flow through it when coupled to a voltage supply. Other example bias components include, but are not limited to, a reverse bias diode supplying a leakage current or a field effect transistor (FET), such as a junction field effect transistor ("JFET") or a metal-oxide semiconductor field effect transistor ("MOSFET"), with its gate tied or connected to its source.

The terms node, connected, and coupled, are used when describing the example circuit embodiments shown within the drawings. A "node" is any internal or external reference point, connection point, junction, signal line, conductive element, or the like, at which a given signal, logic level, voltage, data pattern, current, or quantity is present. A node or feature that is "coupled" can be either directly or indirectly joined to or in direct or indirect communication with another node or feature. A node or feature that is "connected" is directly joined to or is in direct communication with another node or feature. Moreover, the various circuit schematics shown herein depict certain components, elements, features, or nodes as being directly connected. However, additional intervening elements, devices, features, or components may be present in an actual embodiment or in additional embodiments (some of which are shown in FIGS. 3-7 and some of which are not shown for brevity), assuming that the functionality of the given circuit is not adversely affected.

As depicted in FIG. 1, one terminal of the bias component 104 is coupled to a voltage supply node 120, which is a node that is directly connected to the voltage supply 102. The voltage supply 102 is also connected to a voltage common node 130, which is a node that is directly connected to another voltage referred to herein as a voltage common 118. Voltage common 118 in this case is electrical ground or simply ground. In this example PTAT circuit architecture, the terminal of the bias component 104 is directly connected to the voltage supply 102. However, as illustrated in other embodiments described herein, the bias component can be coupled to the voltage source through at least one intermediary component such as through a current mirror.

The set of four transistors 106, 108, 110, and 112 are also referred to herein for ease of reference as a "first transistor 106," a "second transistor 108," a "third transistor 110," and a "fourth transistor 112." The first 106 and second 108 transistors form a current splitter; and the third 110 and fourth 112 transistors are sized differently and, thereby, have different current densities, which enables the provision of a regulated PTAT current, which is more fully described later. Particularly, the third transistor 110 is larger than the fourth transistor 112 by a factor of N. In one embodiment, the third transistor 110 is 8 times larger than the fourth transistor 112. However, N can be any suitable current density ratio including, but not limited to, 2:1, 4:1, etc.

Illustratively, the first transistor 106 and the second transistor 108 are depicted in the FIGs. and described herein as MOSFETs, having first and second terminals termed interchangeably as a source and a drain and a control terminal termed as a gate. The third transistor 110 and the fourth transistor 112 are depicted in the FIGs. and described herein as bipolar junction transistors ("BJTs"), having first and second terminals termed interchangeably as a collector and an emitter and a control terminal termed as a base. In the particular embodiment depicted, the transistors 106 and 108 are p-channel MOSFETS, also known as PMOS transistors; and the transistors 110 and 112 are NPN BJTs.

Accordingly, the other terminal of the bias component 104 is connected to the source of the first transistor 106 and the source of the second transistor 108 at a node 122. The gate and drain of the first transistor 106 are connected together at a node 124 and are connected to the collector of the third transistor 110. The collector and base of the third transistor 110 are connected together at node 124. The emitter of the third transistor 110 is connected to a node 132. The gate of the second transistor 108 is connected to node 124, and the drain of the second transistor 108 is connected to the collector of the fourth transistor 112 at a node 126. The bases of the third transistor 110 and the fourth transistor 112 are tied together at node 124. The fourth transistor 112 is further coupled to the voltage common node 130, with the coupling in this case being a direct connection of the emitter of the fourth transistor 112 to the voltage common node 130.

The first resistive component 116 is coupled to node 132 and to the voltage common node 130. Particularly, a first terminal of the first resistive component 116 is connected to the node 132; and a second terminal of the first resistive component 116 is connected to the voltage common node 130. In a particular embodiment, the first resistive component 116 has a resistance value between about 1 and 100 kilo-ohms.

Transistor 114 is referred to as an output transistor, which has an output node 134 connected to one of its current terminals. Illustratively, the output transistor 114 is depicted in the FIGs. and described herein as a MOSFET, having first and second terminals termed interchangeably as a source and a drain and a control terminal termed as a gate. In this particular embodiment, the output transistor 114 is an n-channel MOSFET also referred to as an NMOS transistor. As depicted, the control terminal of the transistor 114 is connected to the drain of the second transistor 108 and the collector of the fourth transistor 112 at node 126. The drain of the transistor 114 is connected to the output node 134. The source of the transistor 114 is connected, at node 132, to the collector of the third transistor 110 and the first terminal of the first resistive component 116.

The general circuit arrangement 100 and characteristics of at least some of the circuit components illustrated in FIG. 1 provide a regulated current source that has some benefits over known current sources. For example, a single bias component 104 is coupled at one terminal to the power supply 102 and is directly connected at the other terminal to current terminals of both transistors 106 and 108 of the current splitter. The bias component 104, thereby, controls a bias current, which is provided as a combined "tail" current that is split into both legs of the current splitter. This is contrary to prior art circuits having a current mirror directly connected to the power supply and/or that uses a resistive component to provide a current that is copied into one or both legs of the current mirror.

Thus, at least some described embodiments more efficiently use a bias resistor with a lower current consumption (in some instances 2 or 3 times lower) than prior art circuits for a given value of resistance. Moreover, since the current splitter of the present teachings is not directly connected to the power supply, smaller low-voltage transistors (which see only a fraction of the power supply voltage) can be used. The embodiments save space on the IC over prior art circuits having a current mirror directly connected and exposed to the full value of the power supply, including any spikes in voltage. A low-voltage transistor, for instance a low voltage MOSFET, is a transistor having a breakdown voltage that is less than a maximum expected value of the power supply.

Additionally, as mentioned above, third 110 and fourth 112 transistors have different current densities, which in some embodiments enables a regulated current source (referred to as a PTAT current source) over a wider range of supply voltage values than is possible with prior art circuits, irrespective of the current through the bias component 104. This feature is further described and understood in the context of the general operation of circuit 100 and the operation of circuits shown in FIGS. 3-7.

Figure 2:
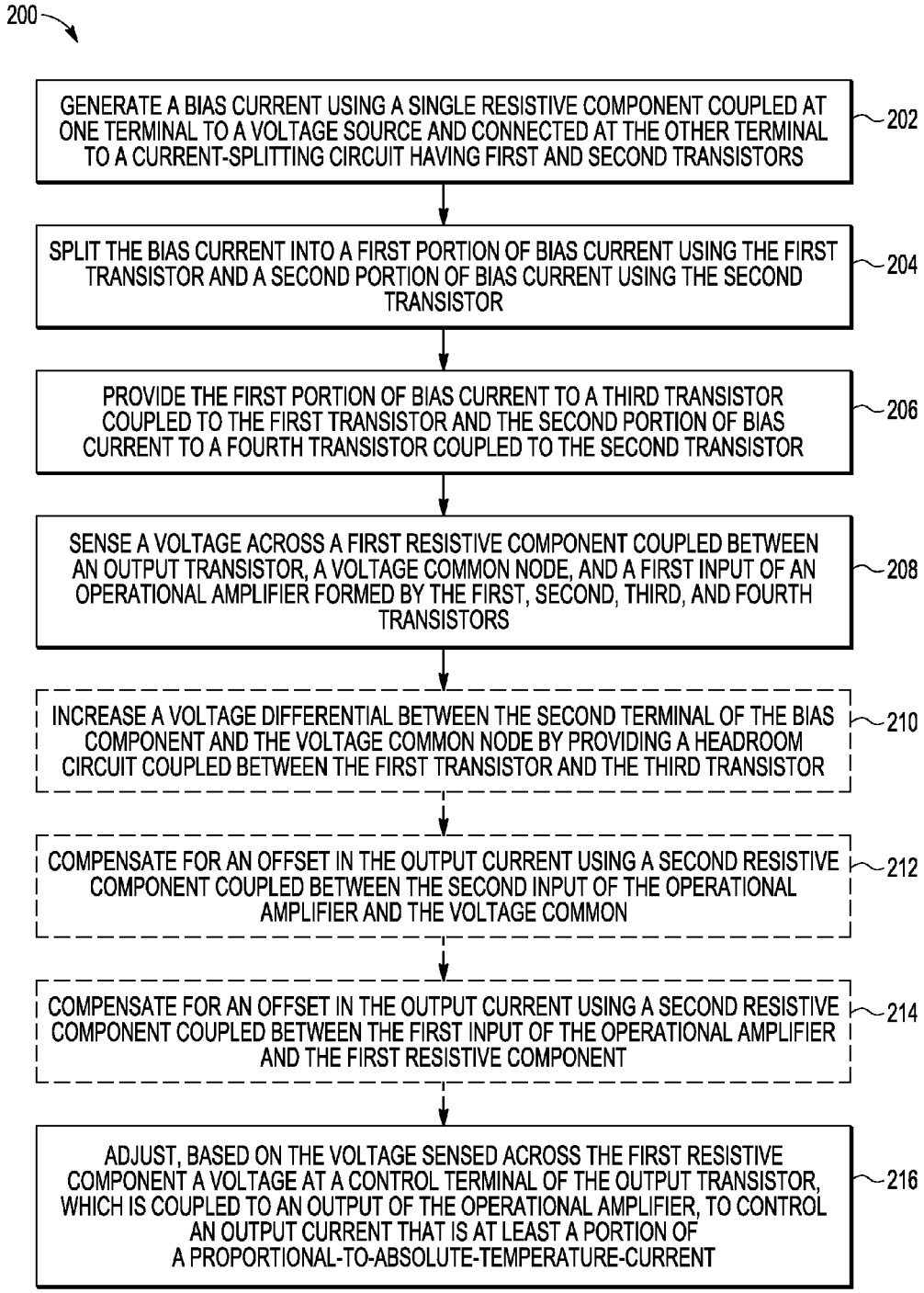
FIG. 2 is a general flow diagram illustrating a method for regulating an output current of a PTAT circuit, in accordance with an embodiment.

FIG. 2 is a general flow diagram illustrating a method 200 for regulating an output current, in accordance with an embodiment. In a particular embodiment, method 200 represents the operation of circuit 100 and the components therein. Accordingly, at least some functional blocks of the flow diagram are described by reference to components in FIG. 1. However, in other embodiments, the method 200 represents the operation of circuits illustrated in at least some of the remaining FIGS. 3 to 7. Moreover, method 200 may be performed within the context of a larger functionality of one or more of the described circuits and, thereby, encompass additional functions that are shown not shown in FIG. 2.

As illustrated, method 200 begins at block 202 where a single or sole bias component, such as the bias component 104, generates a bias current to provide to a current-splitting circuit that includes the first 106 and second 108 transistors. The bias component 104 has a first terminal coupled to a voltage supply and a second terminal directly connected to the current-splitting circuit.

At block 204, the bias current flowing through the bias component 104 is split into a first portion of the bias current provided to the first transistor 106 and a second portion of the bias current provided to the second transistor 108. Where the transistors 106 and 108 are substantially the same size, these transistors operate as a current mirror such that substantially the same magnitude of current flows through each of transistors 106 and 108.

However, in various other embodiments, transistors 106 and 108 can have different sizes, such that one transistor is larger than the other. For these embodiments, different current magnitudes flow through the transistors 106 and 108 in direct relation to the ratio of the sizes of these transistors, which impacts equations that define the PTAT current generated by the circuit, as described later. For example, where the ratio of the size of transistors 106 to 108 is 1:m, the bias current splits with a fraction 1/(m+1) of the bias current going through transistor 106 and the remaining fraction m/(m+1) of the bias current going through transistor 108.

The method 200 continues at block 206 where the circuit 100 provides the current from the first transistor 106 to the third transistor 110 and the current from the second transistor 108 to the fourth transistor 112. The four transistors 106, 108, 110, 112 operate as, or similar to, an operational amplifier having: a first input connected to the emitter of the third transistor 110; a second input connected to the emitter of the fourth transistor 112; and an output connected to the collector of the fourth transistor 112. The operational amplifier is balanced when the current through the third 110 and fourth 112 transistors is proportional to the size ratio between the first 106 and second 108 transistors. For instance, where the first 106 and second 108 transistors are substantially matched, the operational amplifier is balanced when the current through the third transistor 110 has substantially the same magnitude as the current through the fourth transistor 112.

Moreover, the operational amplifier, as configured, has a known voltage offset between the first and second inputs, which is based on the current density difference between the third 110 and fourth 112 transistors. Where the third 110 and fourth 112 transistors are BJTs, as illustrated, the known voltage offset is a difference in VBEs or deltaVBE (i.e., base-to-emitter voltages) between the third 110 and fourth 112 transistors. Accordingly, when the operational amplifier is balanced, the voltage across the first resistive component 116 is deltaVBE, which provides a current through the output transistor 114 and through the output node 134 that is the PTAT current or that combines with the current through the bias component 104 to form the PTAT current.

To balance the operational amplifier, at block 208, the voltage across the first resistive component 116 is sensed at the emitter of the third transistor 110. At block 216, the operational amplifier adjusts the voltage at the control terminal of the output transistor 114, which drives the transistor 114 to control the current flowing in the transistor 114. This balancing proceeds until equations are solved for maintaining the known deltaVBE across the resistive component 116 and the correct currents through the third 110 and fourth 112 transistors, thereby, providing the regulated PTAT current. The particular equations that are balanced depend on the particular circuit embodiment, as will be demonstrated later when describing various embodiments illustrated by reference to the remaining figures.

For one example, where the voltage across the resistive component 116 is sensed at the emitter of the third transistor 110 as being lower than deltaVBE, the fourth transistor 112 will turn off. Correspondingly, the collector voltage of the fourth transistor 112 rises, which drives the output transistor 114 on stronger to pull up the node 132 connected to the source of the output transistor 114. This increases the output current at the node 134 and, thereby, maintains the PTAT current, which is based on the output current. Conversely, where the voltage across the resistive component 116 is sensed at the emitter of the third transistor 110 as being higher than deltaVBE, the fourth transistor 112 will turn on or turn on stronger. Correspondingly, the collector voltage of the fourth transistor 112 falls, which drives the output transistor 114 less. This pulls down the node 132 connected to the source of the output transistor 114, thereby decreasing the output current at the node 134 and maintaining the PTAT current, which is based on the output current.

Blocks 210, 212, and 214 represent functionality of alternative embodiments containing additional circuit components. For example, an additional circuit component, referred to herein as a headroom circuit, is included in some embodiments to perform functionality represented at block 210 in order for the PTAT circuit to be able to provide sufficient voltage to the gate of the output transistor 114 to turn that transistor on in order to provide the output current. Moreover, the PTAT current generated in circuit 100 can be any designed value supported by the particular components used in the circuit.

However, in a particular embodiment, the PTAT current is small, for instance within the range of 1 to 10 μA. and is comparable in size to the currents in the transistors 110 and 112. For this implementation, additional resistive components can be included in the circuit 100 to perform functionality represented at blocks 212 and 214 to compensate, e.g., by reducing or eliminating, errors or offsets in the output current. For example, in an embodiment to compensate for offset, a second resistive component is coupled between the first input of the operational amplifier and the first resistive component so that the proportional-to-absolute-temperature current is a sum of the output current through the output transistor and a current through the bias component. In another embodiment to compensate for an offset caused by the bias currents, a second resistive component is coupled between the second input of the operational amplifier and the voltage common, so that the proportional-to-absolute-temperature current is the output current through the output transistor.

Figure 3:
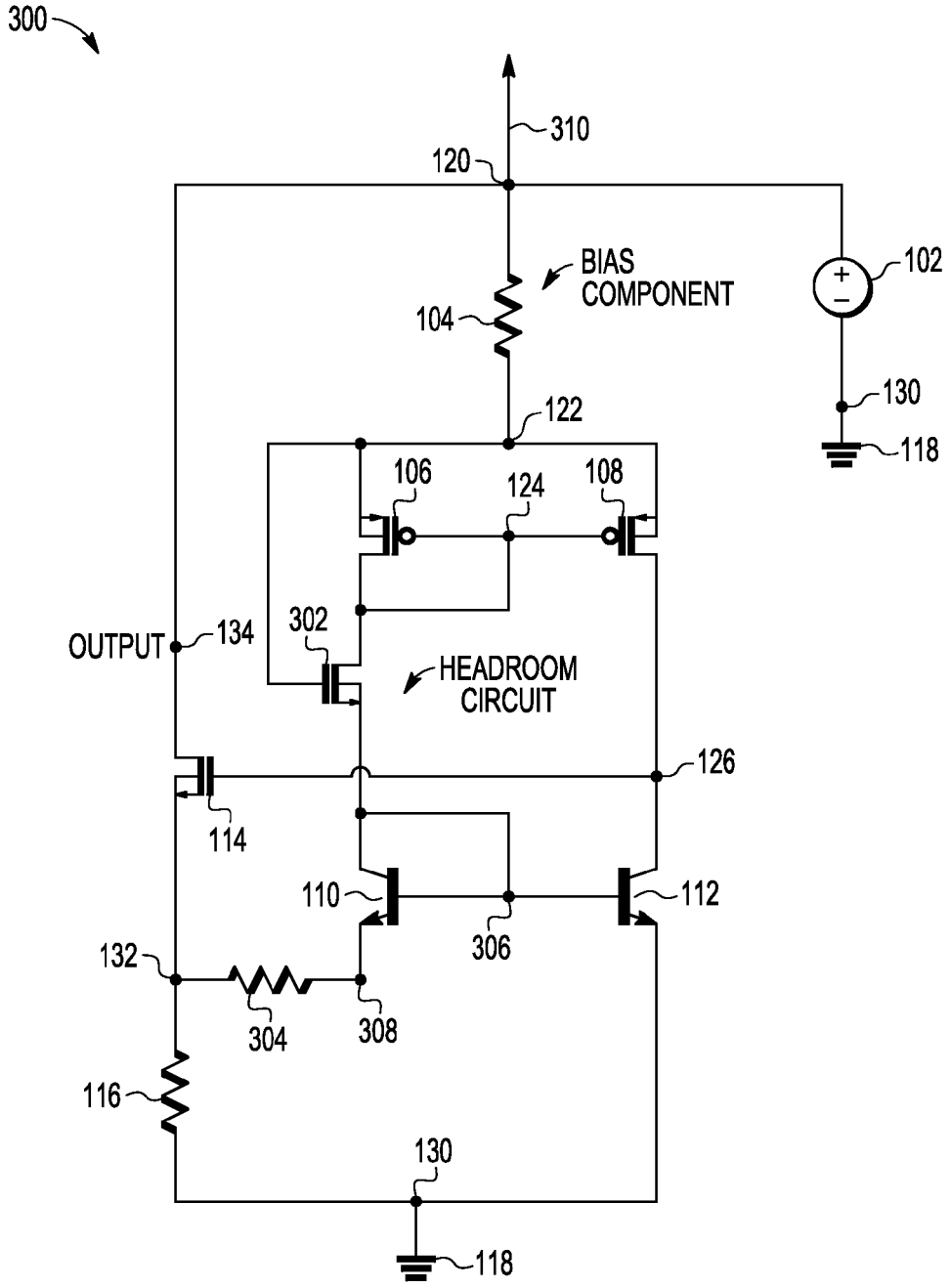
FIG. 3 is a circuit diagram illustrating a PTAT circuit, in accordance with an embodiment.

FIG. 3 is a circuit diagram illustrating a PTAT circuit 300, in accordance with an embodiment. The PTAT circuit 300 includes the components of the voltage source 102, the bias component 104, transistors 106, 108, 110, 112, and 114 and the resistive component 116 as shown in the PTAT circuit 100 of FIG. 1 and having a substantially similar connectivity and operation as described above. However, the PTAT circuit 300 further includes a second resistive component 304 and a headroom circuit 302.

The second resistive component 304 is connected at node a 308 to the emitter of the third transistor 110 and is connected, at node 132, to the source terminal of the output transistor 114 and the first terminal of the first resistive component 116. Output node 134 and node 120 are connected together.

The headroom circuit 302, illustratively depicted as an NMOS transistor, includes: a gate connected to the node 122, a source connected to the collector and base of the third transistor 110 and to the base of the fourth transistor 112, at node 306; and a drain connected to the node 124.

The headroom circuit 302 is included to provide a voltage margin. More particularly, the voltage level at node 122, supplied by the voltage source 102 and bias component 104, can drop to levels that might ordinarily prevent the output transistor 114 from turning "on." The addition of the headroom circuit 302 ensures the voltage difference between node 122 and ground 118, at node 130, is at least the threshold voltage of the headroom circuit 302. In various embodiments, the threshold voltage of the headroom circuit 302 matches the threshold voltage of the output transistor 114 so that there is a large enough voltage available at node 126 to the gate of the first output transistor 114 to turn on the transistor 114. Accordingly, the PTAT circuit 300 can begin to operate as soon as the supply voltage 102 has reached the voltage level of a diode drop (the VBE of transistor 112) plus the threshold voltage of the headroom circuit 302.

The headroom circuit 302 in the embodiment mentioned above matches the output transistor 114. However, the headroom circuit 302 need not match the transistor 114 but need only provide enough voltage margin such that the circuit 100 turns on the output transistor 114 at a low supply voltage value. Additionally, in other embodiments, the headroom circuit 302 is implemented using other components or transistor configurations that supply the needed voltage margin, for instance as described by reference to FIG. 5.

Similarly to circuit 100, the difference in current densities between the third 110 and fourth 112 transistors causes a known deltaVBE between the fourth 112 and third 110 transistors according to equation (1) below:

$$\text{delta}VBE = VBE_{T4} - VBE_{T3} = V_T \ln(N/m), \quad (1)$$

where $VBE_{T3}$ is the base-to-emitter voltage of the third transistor 110; $VBE_{T4}$ is the base-to-emitter voltage of the fourth transistor 112; N is the ratio of the sizes of the third 110 and fourth 112 transistors; $V_T$ is the thermal voltage, which can be calculated by k*T/q, where k is Boltzmann's constant, T is the absolute temperature, and q is the magnitude of the electrical charge of an electron; and m is the ratio of the size of the first transistor 106 to the size of the second transistor 108. For example, where N=8, deltaVBE is about 26 mV at room temperature.

Moreover, the operational amplifier formed by transistors 106, 108, 110, and 112 is balanced, as represented by equation (2) below, when: the currents through the transistors 110 and 112 are balanced based on the ratio, m, of the transistors 106 and 108; when the deltaVBE between the transistors is $V_T \ln(N/m)$ as represented in equation (1); and when the ratio of resistance values of resistive components 116 and 304 is equal to m, e.g., $R_{304}=R_{116}/m$. Equation (2) is as follows:

$$VBE_{T4} = VBE_{T3} + 2*IBIAS*m/(m+1)*R_{304} + (2*IBIAS*m/(m+1)+IOUT)*R_{116} \quad (2),$$

where $VBE_{T3}$ is the base-to-emitter voltage of the third transistor 110; $VBE_{T4}$ is the base-to-emitter voltage of the fourth transistor 112; 2*IBIAS is the total current through the bias component 104; m is the ratio of the sizes of the first 106 and second 108 transistors; IOUT is the current through the output transistor 114; $R_{304}$ is the resistance value of resistive component 304; and $R_{116}$ is the resistance value of resistive component 116.

Equation (2) can, thus, be further simplified to equations (3), (4), (5), and (6) below:

$$V_T \ln(N/m) = 2*IBIAS*m/(m+1)*R_{304} + (2*IBIAS*m/(m+1)+IOUT)*R_{116} \quad (3)$$

$$= 2*IBIAS*m/(m+1)*R_{116}/m + (2*IBIAS*m/(m+1)+IOUT)*R_{116} \quad (4)$$

$$= 2*IBIAS*R_{116}/(m+1) + 2*IBIAS*m/(m+1)*R_{116} + IOUT*R_{116} \quad (5)$$

$$= 2*IBIAS*R_{116} + IOUT*R_{116}, \quad (6)$$

where it can be seen from equation (6) that the PTAT current=2*IBIAS+IOUT or the sum of the current through the bias component 104 and the current through the output transistor 114.

The first resistive component 116 and second resistive component 304 have a same ratio as the first transistor 106 and second transistor 108. When transistors 106 and 108 are about the same size, i.e., where m=1, the resistive components 116 and 304 should likewise be set to be about the same size or have about the same resistance value. Accordingly, the deltaVBE equation (1) simplifies to equation (7) below:

$$\text{delta}VBE = VBE_{T4} - VBE_{T3} = V_T \ln(N), \quad (7),$$

where deltaVBE is about 54 mV at room temperature.

Similarly, the equation (2) representing the balancing of the operational amplifier formed by the transistors 106, 108, 110, and 112 simplifies to equation 8 below:

$$VBE_{T4} = VBE_{T3} + IBIAS*R_{304} + (IBIAS+IOUT)*R_{116} \quad (8).$$

Equation (8) further simplifies to equations (9) and (10) below:

$$V_T \ln(N) = IBIAS*R_{116} + (IBIAS+IOUT)*R_{116} \quad (9)$$

$$= 2*IBIAS*R_{116} + IOUT*R_{116}, \quad (10),$$

where it can once again be seen from equation (10) that the PTAT current=2*IBIAS+IOUT or the sum of the current through the bias component 104 and the current through the output transistor 114. Moreover, as can be further seen from equations (6) and (10), the circuit 300 operates to generate a useful PTAT current when the bias component 104 is selected such that current through the bias component 104 is less than $V_T \ln(N)/R_{116}$ so that a current can be generated through the output transistor 114.

Figure 4:
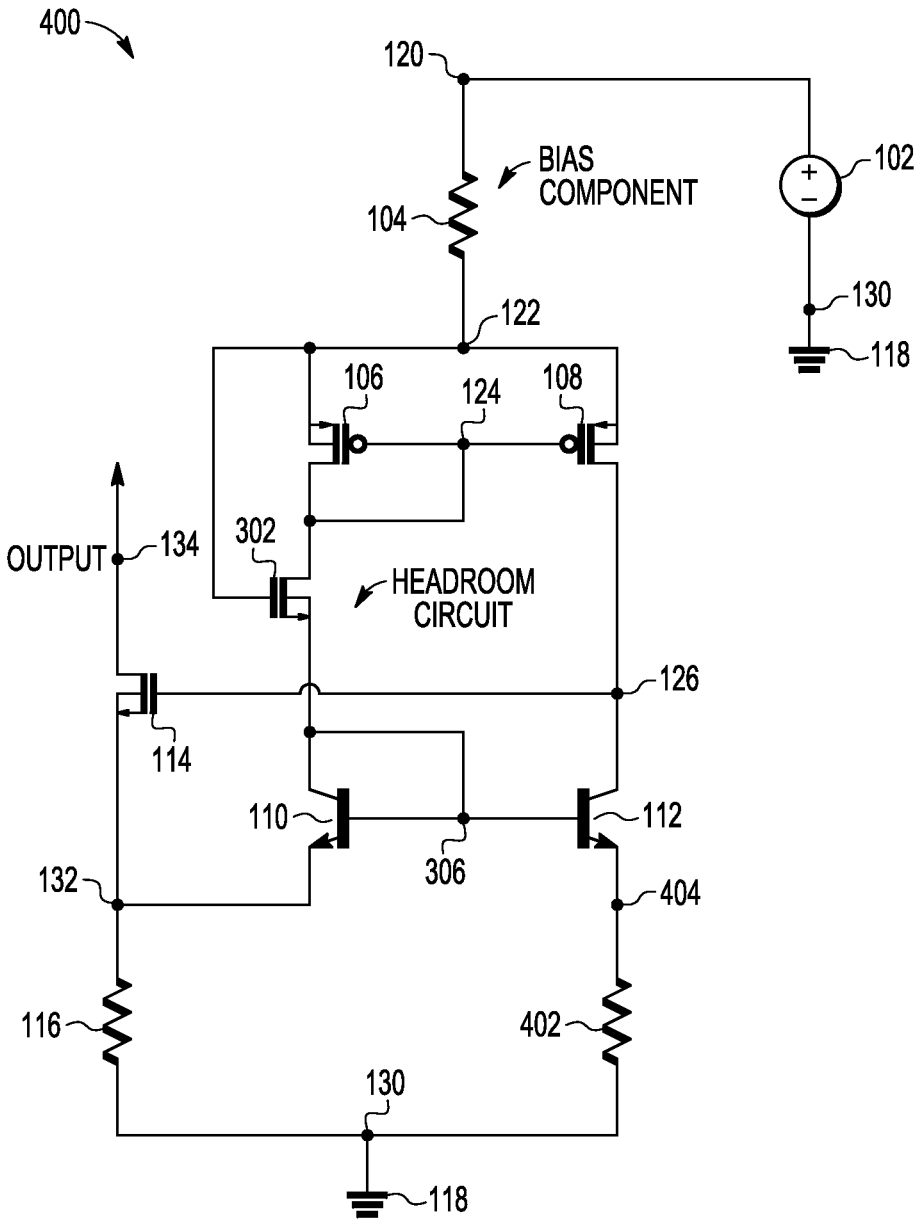
FIG. 4 is a circuit diagram illustrating a PTAT circuit, in accordance with an embodiment.

FIG. 4 is a circuit diagram illustrating a PTAT circuit 400, in accordance with an embodiment. The PTAT circuit 400 includes the components of the voltage source 102, the bias component 104, transistors 106, 108, 110, 112, and 114, and the resistive component 116 as shown in the PTAT circuit 100 of FIG. 1 and the headroom circuit 302 depicted in FIG. 3 and having a substantially similar connectivity and operation as described above. However, the PTAT circuit 400 further includes a second resistive component 402. The resistive component 402 has a first terminal that is connected, at node 404, to the emitter of the fourth transistor 112 and a second terminal that is connected to the voltage common node 130.

Similarly to circuit 100, the difference in current densities between the third 110 and fourth 112 transistors causes a known deltaVBE between the third 110 and fourth 112 transistors according to equation (1) above. Moreover, the operational amplifier formed by transistors 106, 108, 110, and 112 is balanced, as represented by equation (11) below, when: the currents through the transistors 110 and 112 are balanced based on the ratio, m, of the transistors 106 and 108; when the deltaVBE between the transistors is $V_T \ln(N/m)$ as represented in equation (1); and when the ratio of resistance values of resistive components 116 and 304 is equal to m, e.g., $R_{402}=R_{116}/m$. Equation (11) is as follows:

$$2*IBIAS*1/(m+1)*R_{402}+VBE_{T4}=VBE_{T3}+(2*IBIAS*m/(m+1)+IOUT)*R_{116} \quad (11),$$

where $VBE_{T3}$ is the base-to-emitter voltage of the third transistor 110; $VBE_{T4}$ is the base-to-emitter voltage of the fourth transistor 112; 2*IBIAS is the current through the bias component 104; m is the ratio of the sizes of the first 106 and second 108 transistors; IOUT is the current through the output transistor 114; $R_{402}$ is the resistance value of resistive component 402; and $R_{116}$ is the resistance value of resistive component 116.

Equation (11) can, thus, be further simplified to equations (12), (13), and (14) below:

$$V_T \ln(N/m)=(2*IBIAS*1/(m+1)+IOUT)*R_{116}-2*IBIAS*m/(m+1)*R_{402} \quad (12)$$

$$=2*IBIAS*1/(m+1)*R_{116}+IOUT*R_{116}-2IBIAS*m/(m+1)*R_{402} \quad (13)$$

$$=IOUT*R_{116} \quad (14)$$

where it can be seen from equation (14) that the PTAT current is IOUT or the current through the output transistor 114.

The first resistive component 116 and second resistive component 304 have a same ratio as the first transistor 106 and second transistor 108. When transistors 106 and 108 are about the same size, i.e., where m=1, the resistive components 116 and 402 should likewise be set to be about the same size or have about the same resistance value. Accordingly, the deltaVBE equation (1) simplifies to equation (7) above.

Similarly, the equation (11) representing the balancing of the operational amplifier formed by the transistors 106, 108, 110, and 112 simplifies to equation (15) below:

$$IBIAS*R_{402}+VBE_{T4}=VBE_{T3}+(IBIAS+IOUT)*R_{116} \quad (15)$$

Equation (15) further simplifies to equations (16) below:

$$V_T \ln(N)=IOUT*R_{116}, \quad (16),$$

where it can once again be seen from equation (10) that the PTAT current is IOUT or the current through the output transistor 114. Moreover, as can be further seen from equations (16), the circuit 400 operates to generate a useful PTAT current that is independent of the current through the bias component 104. Therefore, in this embodiment, great flexibility is provided for the selection of the bias component 104. Moreover, a predictable and controllable PTAT current is generated through the transistor 114 at a wide range of supply voltage values.

Figure 5:
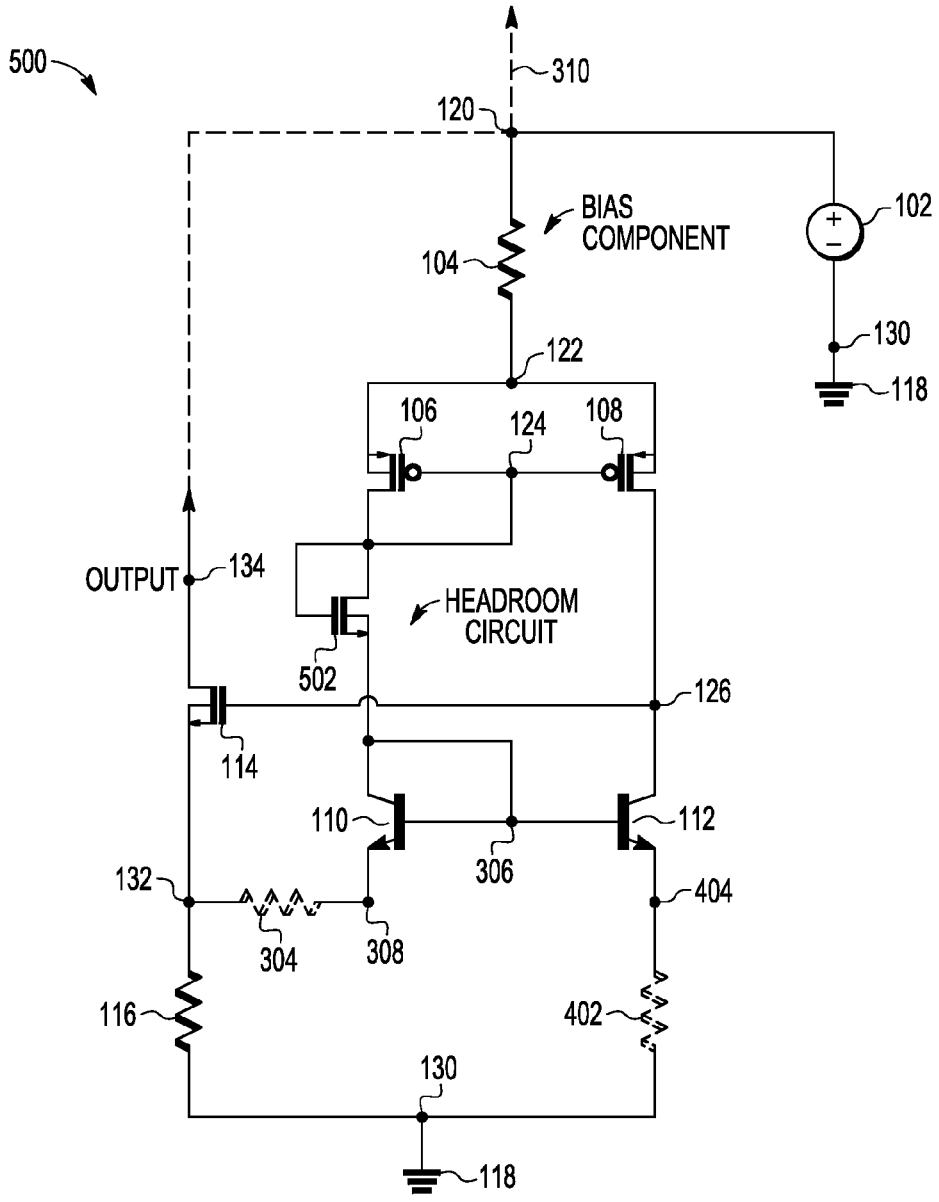
FIG. 5 is a circuit diagram illustrating a PTAT circuit, in accordance with an embodiment.

FIG. 5 is a circuit diagram illustrating a PTAT circuit 500, in accordance with an embodiment. The PTAT circuit 500 includes the components of the voltage source 102, the bias component 104, transistors 106, 108, 110, 112, and 114, and the resistive component 116 as shown in the PTAT circuit 100 of FIG. 1 and having a substantially similar connectivity and operation as described above. FIG. 5 further includes a headroom circuit 502.

The headroom circuit 502 is depicted as a diode-connected NMOS transistor having its gate and drain connected together at the node 124 and its source connected to node 306. In this embodiment, the voltage of the first transistor 106, the headroom circuit 502, and the third transistor 110 should exceed the threshold voltage of the output transistor 114 to help prevent the voltage level at node 122, supplied by the voltage source 102, from dropping to levels that might ordinarily prevent the output transistor 114 from turning on. Selection of the headroom circuits described herein, and depicted in FIGS. 3-7, is mutually exclusive of the selection of whether to include the resistive component 304 or 402 or which type and connectivity of bias component to include in the circuit.

One implementation of circuit 500 includes the resistive component 304 as depicted in FIG. 3, the connectivity and operation of which is described above. In this implementation, the drain of the output transistor 114 is connected to the node 120; and the PTAT current is the sum of the current through the output transistor 114 and the current through the bias component 104, as indicated by the dashed line 310. An alternative implementation of the PTAT circuit 500 includes resistive component 402 as depicted in FIG. 4, the connectivity and operation of which is described above. In this implementation, the PTAT current is the output current through the output transistor 114.

Figure 6:
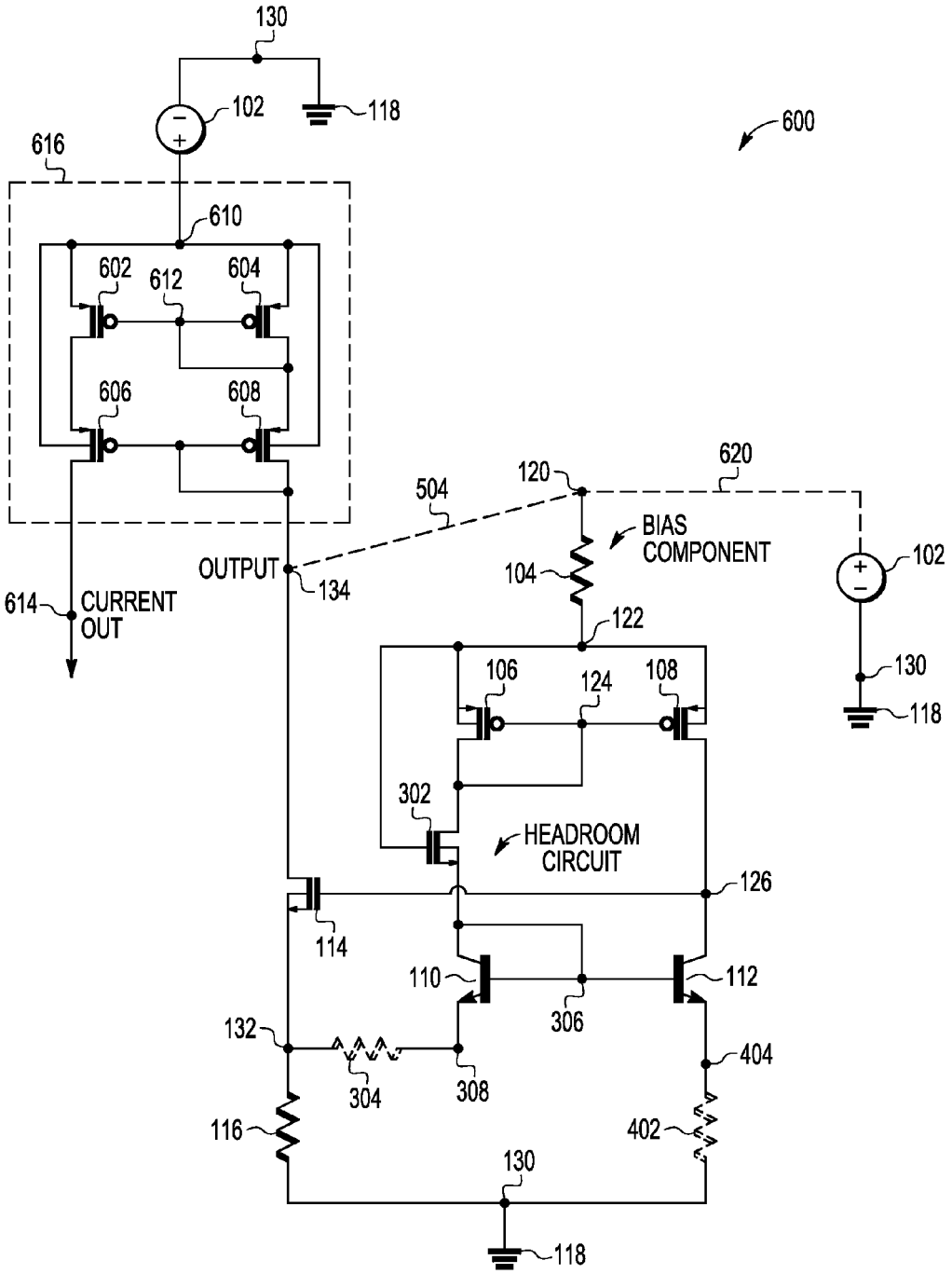
FIG. 6 is a circuit diagram illustrating a PTAT circuit, in accordance with an embodiment.

FIG. 6 is a circuit diagram illustrating a PTAT circuit 600, in accordance with an embodiment. The PTAT circuit 600 includes the components of the voltage source 102, the bias component 104, transistors 106, 108, 110, 112, and 114, and the resistive component 116 as shown in the PTAT circuit 100 of FIG. 1 and the headroom circuit 302 depicted in FIG. 3 and having a substantially similar connectivity and operation as described above.

The PTAT circuit 600 includes or is connected to a current mirror 616, which is connected to the voltage supply 102 at node 610. The current mirror 616 as depicted includes PMOS transistor 602, 604, 606, and 608. The current mirror 616 is coupled between the output node 134 and a current-out node 614, and is configured to generate at the current-out node 614 a copy of the proportional-to-absolute-temperature current.

As shown, the sources of transistors 602 and 604 are connected together at the node 610. The gates of transistors 602 and 604 are connected together and are connected to the drain of the transistor 604 and the source of the transistor 608. The drain of the transistor 602 is connected to the drain of the transistor 606. The gates of the transistors 606 and 608 are connected together and are connected to the drain of the transistor 608. The drain of the transistor 606 is connected to the current out node 614.

One implementation of circuit 600 includes the resistive component 304 as depicted in FIG. 3, the connectivity and operation of which is described above. In this implementation, the drain of the output transistor 114 is connected to the node 120 and to the drain of the transistor 608. Furthermore, as depicted for this implementation, the bias component 104 is not directly connected to the voltage supply 102 but is coupled to the voltage supply 102 through the current mirror. Thus, the PTAT current provided to the current mirror 616 and mirrored through the current out node 614 is the sum of the current through the output transistor 114 and the current through the bias component 104.

An alternative implementation of the PTAT circuit 600 includes resistive component 402 and the first terminal of the bias component connected to the voltage supply node as depicted in FIG. 4, the connectivity and operation of which is described above. In this implementation, the PTAT current provided to the current mirror 616 and mirrored through the current out node 614 is the output current through the output transistor 114.

Figure 7:
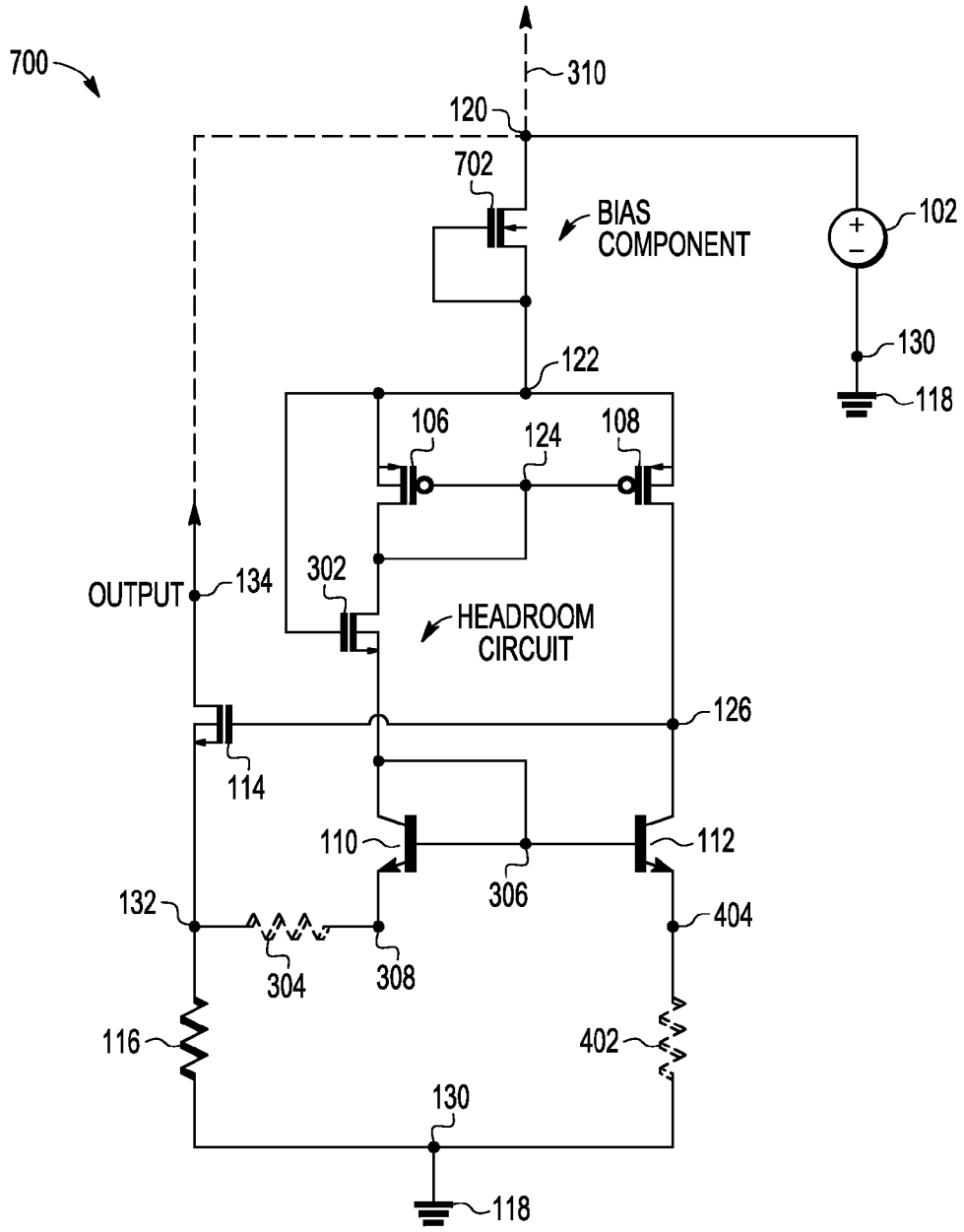
FIG. 7 is a circuit diagram illustrating a PTAT circuit, in accordance with an embodiment.

FIG. 7 is a circuit diagram illustrating a PTAT circuit 700, in accordance with an embodiment. The PTAT circuit 700 includes the components of the voltage source 102, the bias component 104, transistors 106, 108, 110, 112, and 114, and the resistive component 116 as shown in the PTAT circuit 100 of FIG. 1 and the headroom circuit 302 depicted in FIG. 3 and having a substantially similar connectivity and operation as described above. In addition, the PTAT circuit 700 includes a depletion mode FET with its gate tied to its source as a bias component 702. The bias component 702 can provide a sufficient start-up current of about 0.1 micro-amps to about 10 micro-amps.

One implementation of circuit 500 includes the resistive component 304 as depicted in FIG. 3, the connectivity and operation of which is described above. In this implementation, the drain of the output transistor 114 is connected to the node 120; and the PTAT current is the sum of the current through the output transistor 114 and the current through the bias component 104, as indicated by the dashed line 310. An alternative implementation of the PTAT circuit 500 includes resistive component 402 as depicted in FIG. 4, the connectivity and operation of which is described above. In this implementation, the PTAT current is the output current through the output transistor 114.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

In the embodiments described herein, and depicted in the FIGs., some components are depicted and described as a single component. However, these depictions and descriptions are not intended, in any way, to limit the scope of the material taught herein. For example, in FIG. 3, the bias component 104 can have multiple resistive components connected in series or parallel. In various embodiments, the first resistive component 116, the resistive component 304, and the resistive component 402 can be implemented as multiple resistors to achieve a desired effect. For example, the multiple resistors can be a resistor having a positive temperature coefficient and a resistor having a negative temperature coefficient in series to achieve an equivalent resistance having a targeted temperature coefficient.

For the sake of brevity, current mirrors, individual system operating components, and other functional aspects of the system may not be described in detail. Furthermore, the connecting lines shown in the various figures contained herein are intended to represent example functional relationships and/or physical couplings between the various elements. It should be noted that many alternative or additional functional relationships or physical connections may be present in a practical embodiment. In addition, for ease of discussion, the figures depict FETs and BJTs, but those skilled in the art can adapt illustrated techniques with other transistors using the provided guidelines without departing from the scope of the present disclosure.

An "Abstract of the Disclosure" is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A proportional-to-absolute-temperature current source circuit comprising:

a bias component having first and second terminals, wherein the first terminal is coupled to a voltage supply node;

a set of transistors comprising first, second, third, and fourth transistors, wherein the third and fourth transistors are configured to have different current densities, the first and second transistors are connected to the second terminal of the bias component, the first transistor is further coupled to the third transistor, and the second transistor is further coupled to the fourth transistor, which is further coupled to a voltage common node;

a first resistive component coupled to the voltage common node;

an output transistor having a control terminal and first and second current terminals, wherein the control terminal is coupled to the second and fourth transistors, the second current terminal is coupled to the third transistor and the first resistive component, and the first current terminal is connected to an output node, wherein the current source circuit is configured to generate, at the output node, at least a portion of a proportional-to-absolute-temperature current.

2. The current source circuit of claim 1 further comprising a headroom circuit coupled between the first and third transistors, wherein the headroom circuit is configured to increase a voltage differential between the second terminal of the bias component and the voltage common node.

3. The current source circuit of claim 2, wherein the headroom circuit comprises a metal-oxide-semiconductor field-effect transistor having a control terminal connected to the second terminal of the bias component.

4. The current source circuit of claim 2, wherein the headroom circuit comprises a diode-connected field-effect transistor.

5. The current source circuit of claim 1, wherein the third and fourth transistors are bipolar junction transistors configured to have a difference in base-to-emitter voltages.

6. The current source circuit of claim 1, wherein the first terminal of the bias component is connected to the voltage supply node.

7. The current source circuit of claim 1 further comprising a second resistive component coupled between the fourth transistor and the voltage common node.

8. The current source circuit of claim 7, wherein the first and second resistive components have a same ratio as the first and second transistors.

9. The current source circuit of claim 1 further comprising a second resistive component coupled between the third transistor and the second current terminal of the output transistor.

10. The current source circuit of claim 9, wherein the first and second resistive components have a same ratio as the first and second transistors.

11. The current source circuit of claim 1, wherein the bias component is a resistor.

12. The current source circuit of claim 1, wherein the bias component is a depletion mode field-effect transistor having a gate terminal connected to a source terminal.

13. The current source circuit of claim 1 further comprising a current mirror coupled between the output node and a current-out node, wherein the current mirror is configured to generate at the current-out node a copy of the proportional-to-absolute-temperature current.

14. The current source circuit of claim 13 further comprising a second resistive component coupled between the fourth transistor and the voltage common node, wherein the first terminal of the bias component is connected to the voltage supply node.

15. The current source circuit of claim 13 further comprising a second resistive component coupled between the third transistor and the second current terminal of the output transistor, wherein the first terminal of the bias component is coupled to the voltage supply node through the current mirror.

16. The current source circuit of claim 1, wherein the set of transistors is configured as an operational amplifier having:

a first input at a current terminal of the third transistor, which is coupled to the second terminal of the output transistor;

a second input at a second current terminal of the fourth transistor, which is coupled to the voltage common node; and an amplifier output at a first current terminal of the fourth transistor, which is coupled to the control terminal of the output transistor, wherein the operational amplifier is configured to have a voltage offset, between the first and second inputs, which is based on a current density difference between the third and fourth transistors.

17. A method for generating a proportional-to-absolute-temperature current source, the method comprising:

generating a bias current using a single resistive component coupled at a first terminal to a voltage source and connected at a second terminal to a current-splitting mirror having first and second transistors;

splitting the bias current into a first portion using the first transistor and a second portion using the second transistor;

providing the first portion to a third transistor coupled to the first transistor;

providing the second portion to a fourth transistor coupled to the second transistor and having a difference in current density from the third transistor, wherein the first, second, third, and fourth transistors form an operational amplifier having a voltage offset, between first and second inputs of the operational amplifier, which is due to the difference in current densities;

sensing a voltage across a first resistive component coupled between an output transistor, a voltage common, and the first input of the operational amplifier;

adjusting, based on the voltage sensed across the first resistive component, a voltage at a control terminal of the output transistor, which is coupled to an output of the operational amplifier, to control an output current in the output transistor that is at least a portion of a proportional-to-absolute-temperature current.

18. The method of claim 17 further comprising compensating for an offset in the proportional-to-absolute-temperature current using a second resistive component coupled between the second input of the operational amplifier and the voltage common, wherein the proportional-to-absolute-temperature current is the output current in the output transistor.

19. The method of claim 17 further comprising compensating for an offset in the proportional-to-absolute-temperature current using a second resistive component coupled between the first input of the operational amplifier and the first resistive component, wherein the proportional-to-absolute-temperature current is a sum of the output current in the output transistor and a current in the bias component.

20. The method of claim 17, wherein the voltage at the control terminal of the output transistor is adjusted such that the output current is based on a difference in base-to-emitter voltages between the third and fourth transistors.

* * * * *